US008421692B2

(12) United States Patent
Stoneback et al.

(10) Patent No.: US 8,421,692 B2
(45) Date of Patent: Apr. 16, 2013

(54) TRANSMITTING POWER AND DATA

(75) Inventors: Matthew A. Stoneback, Federal Way, WA (US); Ming Chen, Bellevue, WA (US); David M. Anderson, Sammamish, WA (US)

(73) Assignee: The Boeing Company, Chicaco, IL (US)

( * ) Notice: Subject to any disclaimer, the term of this patent is extended or adjusted under 35 U.S.C. 154(b) by 882 days.

(21) Appl. No.: 12/392,734

(22) Filed: Feb. 25, 2009

(65) Prior Publication Data

US 2010/0214183 A1 Aug. 26, 2010

(51) Int. Cl.
*H01Q 1/28* (2006.01)

(52) U.S. Cl.
USPC ..... 343/705; 343/909

(58) Field of Classification Search ..... 343/705, 343/841, 720, 725, 824, 850, 852, 897, 904–909
See application file for complete search history.

(56) References Cited

U.S. PATENT DOCUMENTS

| | | | | |
|---|---|---|---|---|
| 4,125,841 | A | 11/1978 | Munk | |
| 5,208,603 | A | 5/1993 | Yee | |
| 5,471,224 | A * | 11/1995 | Barkeshli | 343/909 |
| 5,592,186 | A | 1/1997 | Hoofe, IV et al. | |
| 6,346,918 | B1 | 2/2002 | Munk | |
| 6,473,596 | B1 | 10/2002 | Stamper et al. | |
| 6,919,847 | B2 * | 7/2005 | Caplan et al. | 343/705 |
| 7,173,565 | B2 | 2/2007 | Sievenpiper | |
| 7,307,589 | B1 * | 12/2007 | Gregoire et al. | 343/700 MS |
| 7,532,170 | B1 * | 5/2009 | Lee et al. | 343/705 |
| 7,639,206 | B2 * | 12/2009 | Behdad | 343/909 |
| 7,724,203 | B2 * | 5/2010 | Shinoda et al. | 343/897 |
| 7,990,328 | B2 * | 8/2011 | Ragan | 343/756 |
| 8,026,857 | B2 * | 9/2011 | Bommer | 343/708 |
| 2007/0159396 | A1 | 7/2007 | Sievenpiper et al. | |
| 2008/0218416 | A1 * | 9/2008 | Handy et al. | 343/700 MS |
| 2009/0273527 | A1 | 11/2009 | Behdad | |

FOREIGN PATENT DOCUMENTS

EP 1898532 12/2008

OTHER PUBLICATIONS

Combined Search and Examination Report under Sections 17 and 18(3), Great Britain Application No. GB1003133.4, Intellectual Property Office, Jun. 11, 2010, (7 pgs).
Richard Remski et al., Frequency Selective Surfaces, Presentation #4, Ansoft Corporation, Feb. 28, 2003 (34 pgs).

* cited by examiner

*Primary Examiner* — Hoanganh Le
(74) *Attorney, Agent, or Firm* — Toler Law Group

(57) ABSTRACT

Apparatus, systems and methods to transmit power and data are provided. A particular apparatus to transmit power and data includes a transmission medium. The transmission medium includes at least one first frequency selective surface (FSS) layer, at least one second FSS layer, and a dielectric layer separating the at least one first FSS layer and the at least one second FSS layer. In a particular embodiment, the apparatus also includes a first coupler coupled to the transmission medium to send a signal along the transmission medium and a second coupler coupled to the transmission medium. The second coupler may receive signals via the transmission medium, receive power via the transmission medium to power devices coupled to the second coupler, process and send data via the transmission medium, or any combination thereof.

20 Claims, 5 Drawing Sheets

TRANSMITTING POWER AND DATA

This invention was made with Government support under contract number HR0011-07-C-0058 awarded by the United States Defense Advanced Research Projects Agency. The government has certain rights in this invention.

FIELD OF THE DISCLOSURE

The present disclosure is generally related to transmitting power and data.

BACKGROUND

The configuration of systems to transmit power or data in a vehicle can be complicated. When the vehicle is not land-based, e.g., for aircraft or spacecraft, the weight and size of such transmission systems can be a substantial constraint. Additionally, certain types of transmission systems may be relatively inflexible. For example, waveguides may have very tight design constraints, such as physical dimension constraints. As a result, design changes to a system that uses waveguides may be difficult and can result in substantial expense.

Additionally, both waveguide and wire based transmission lines may be constrained to point-to-point connections lying in a single path. The path may be straight or curved, but the path is generally not 2-dimensional. The path is also generally not point-to-multipoint transmission.

A frequency selective surface (FSS) layer may be used as a transmission medium to transmit an electromagnetic signal along a surface. In such configurations, a propagating electromagnetic wave may be bound to a surface of the FSS layer; however, the propagating electromagnetic wave may have a height above the surface and below this surface (i.e., the height in the direction perpendicular to the surface). It may be desired to reduce the height of the propagating electromagnetic wave above (and below) this surface. For example, if the height is not reduced, then conductive or semi-conductive objects that are too near the surface may degrade or impede the transmission of the propagating electromagnetic wave. Further, when a single layer of FSS layer is used as a transmission media (e.g., in a broadband application), the transmission may be limited to a frequency band that the FSS layer is designed to transmit—in combination with coupler design and dielectric material properties.

DETAILED DESCRIPTION

Figure 1:
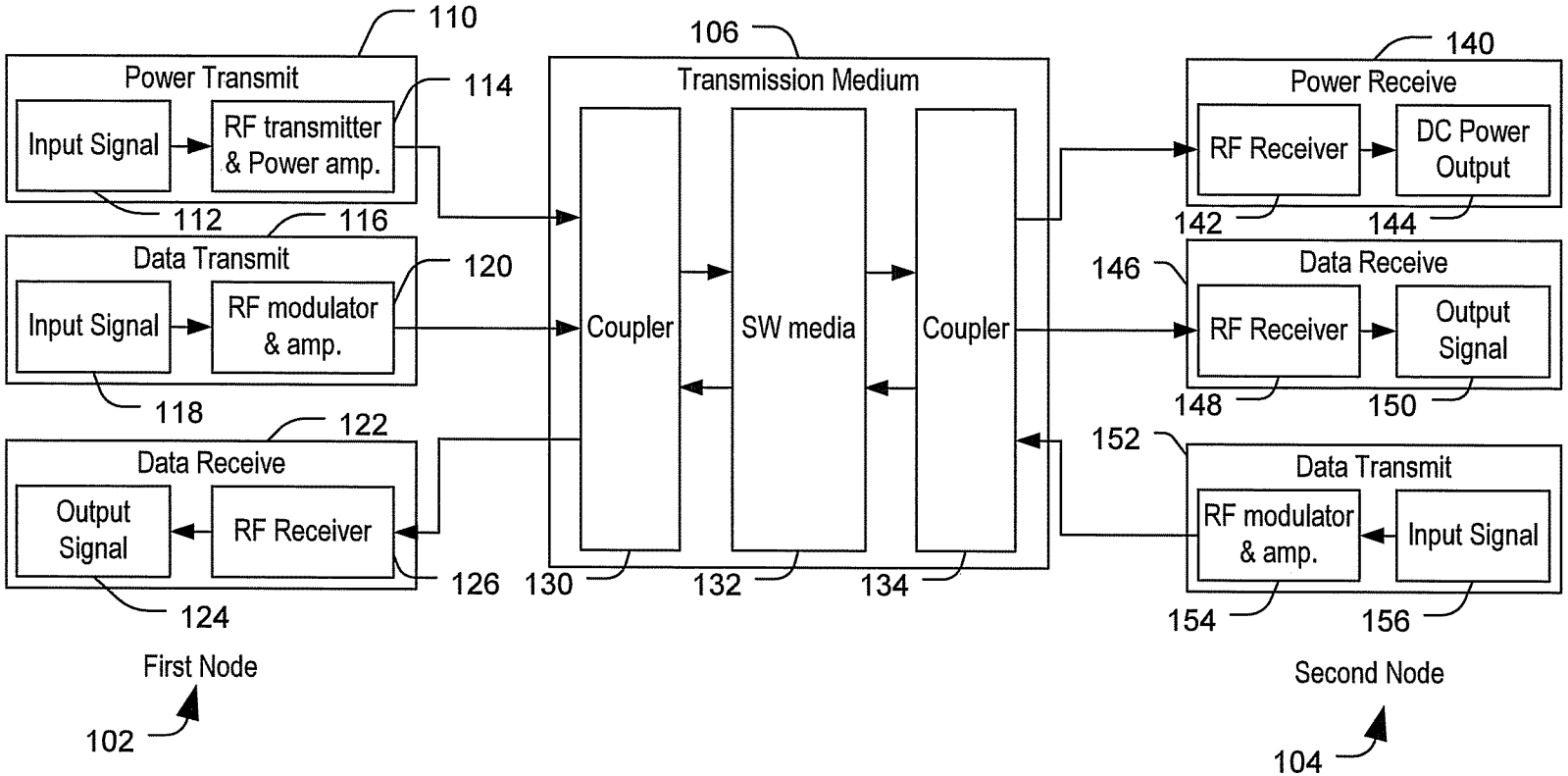
FIG. 1 is a block diagram of a first particular embodiment of a system to transmit power and data.

Apparatus, systems and methods to transmit power and data are provided. A particular apparatus to transmit power and data includes a transmission medium. The transmission medium includes at least one first frequency selective surface (FSS) layer, at least one second FSS layer, and a dielectric layer separating the at least one first FSS layer and the at least one second FSS layer. The apparatus also includes at least one first coupler coupled to the transmission medium to send a signal along the transmission medium and at least one second coupler coupled to the transmission medium to receive the signal sent along the transmission medium. In a particular embodiment, the apparatus also includes a first coupler connected to the transmission medium to send a signal along the transmission medium and a second coupler connected to the transmission medium. The second coupler may receive signals via the transmission medium, receive power via the transmission medium to power devices coupled to the second coupler, process and send data via the transmission medium, or any combination thereof.

In a particular embodiment, the method includes transmitting power from a first node coupled to a transmission medium to a second node coupled to the transmission medium. The method also includes sending data via the transmission medium concurrently with transmitting the power. The transmission medium includes at least one first FSS layer, at least one second FSS layer, and a dielectric layer separating the at least one first FSS layer and the at least one second FSS layer. In various embodiments, the transmission medium may include more than two FSS layers. In a particular embodiment, each of the FSS layers is separated by a dielectric layer of a specific thickness. In the case of more than two FSS layers, dielectric layers may have specific thicknesses that may be different. The specific thicknesses will depend on frequencies (or wavelengths) of signals being used.

In another particular embodiment, the system includes a transmission medium. The transmission medium includes a first frequency selective surface (FSS) layer, a second FSS layer, and a dielectric layer separating the first FSS layer and the second FSS layer. The system also includes a first node coupled to the transmission medium to transmit a power signal via the transmission medium and a second node coupled to the transmission medium to receive the power signal. At least one of the first node and the second node communicates a data signal via the transmission medium concurrently with the power signal being transmitted via the transmission medium. The transmission medium may be a flat 2-dimensional surface or a curved surface where transmission can occur to points on the surface. The disclosed system solves certain problems of using transmission media on aircraft, spacecraft, ground vehicle, or the like. For example, if the surface wave is placed in an enclosure such as a wing or wing box, and if the perpendicular height of the electromagnetic surface wave extends to a distance greater than the wing box height and the wing box enclosure is a semi-conductive or conductive material, then propagation of the signal may be greatly degraded or attenuated. The disclosed multilayer FSS media addresses this issue since the wave travels between and beyond (or outside) the FSS layers but with a reduced height—where more of the signal energy is closer to the FSS layers. In addition, the disclosed multilayer apparatus is adapted to improve transmission performance for low height transmission cavities—thus, reducing transmission attenuation.

FIG. 1 depicts a first particular embodiment of a system to transmit power and data. The system includes a first node 102 and a second node 104 each coupled to a transmission medium 106. Although only two nodes 102, 104 are illustrated in FIG. 1, the system may include any number of nodes coupled via the transmission medium 106. In a particular embodiment, the first node 102 includes a power transmit module 110. The power transmit module 110 is adapted to receive a first input signal 112 and to modify the first input signal 112 for transmission via the transmission medium 106. For example, the power transmission module 110 may include a radio frequency (RF) transmitter and power amplifier 114. The RF transmitter and power amplifier 114 may modulate the first input signal 112 for transmission via the transmission medium 106. In an illustrative embodiment, the radio frequency includes low frequency electromagnetic signals (e.g., up through microwave and high frequency electromagnetic signals). In a particular embodiment, the first node 102 also includes a data transmit module 116. The data transmit module 116 is adapted to receive a second input signal 118 and to modify the second input signal 118 for transmission via the transmission medium 106. For example, the data transmit module 116 may include an RF modulator and amplifier 120. The RF modulator and amplifier 120 may be adapted to modulate the second input signal 118 for transmission via the transmission medium 106.

In a particular embodiment, the first node 102 includes a data receive module 122. The data receive module 122 may be adapted to receive data from the second node 104 via the transmission medium 106. For example, the data receive module 122 may include a RF receiver 126. The RF receiver 126 may receive a modulated signal including data via the transmission medium 106 and generate an output signal 124 at the first node 102. In an illustrative embodiment, the first input signal 112 includes a direct current (DC) power input. The DC power input may be converted to a signal with a frequency or multiple frequency components. In a particular illustrative embodiment, the DC power input may be converted to a time varying signal, such a microwave signal. The second input signal 118 and the output signal 124 may include data. In a particular embodiment, the first node 102 is considered a primary node and is adapted to send the power and to send and receive bidirectional data via the transmission medium 106 via radio frequency (RF) transmissions. In this embodiment, the second node 104 is considered a remote node and is adapted to receive the power and send and receive bidirectional data via the transmission medium 106 via radio frequency (RF) transmissions.

In a particular embodiment, the second node 104 includes a power receive module 140. The power receive module 140 may be adapted to receive power transmitted via the transmission medium 106 from the power transmit module 110 of the first node 102. In a particular embodiment, the power receive module 140 includes an RF receiver 142. The RF receiver 142 is adapted to receive a modulated power signal via the transmission medium 106 and to de-modulate and convert the power signal to generate a DC power output 144. In a particular illustrative embodiment, the power receive module 140 is capable of outputting up to and also more than 0.5 watts of power based on the power signal sent from the power transmit module 110.

In a particular embodiment, the second node 104 includes a data receive module 146. The data receive module 146 is adapted to receive a data signal transmitted by the data transmit module 116 of the first node 102 via the transmission medium 106. For example, the data receive module 146 may include an RF receiver 148. The RF receiver 148 may be adapted to receive the data signal sent by the data transmit module 116. The data receive module 146 may generate an output signal 150 based on the received data signal. The output signal 150 may include, for example, commands to control devices, request data be sent, provide data to be relayed, or the like.

In a particular embodiment, the second node 104 includes a data transmit module 152. The data transmit module 152 is adapted to receive an input signal 156 and to modify the input signal 156 for transmission via the transmission medium 106. For example, the data transmit module 152 may include a RF modulator and amplifier 154. The RF modulator and amplifier 154 may be adapted to receive the input signal 156 and to modulate the input signal 156 for transmission via the transmission medium 106 to the data receive module 122 of the first node 102.

In a particular embodiment, the transmission medium 106 includes a first coupler 130 adapted to couple the first node 102 to the transmission medium 106. The transmission medium 106 also includes a second coupler 134 adapted to couple the transmission medium 106 to the second node 104. In a particular embodiment, more than two couplers may be coupled to the transmission medium 106. For example, the power transmit module 110, the data transmit module 116 and the data receive module 122 may each be coupled to the transmission medium 106 via a separate coupler. The first coupler 130 and the second coupler 134 are adapted to transmit and receive signals sent along the transmission medium 106. In a particular embodiment, the first coupler 130 and the second coupler 134 include directional antennas, beam antennas, high-gain antennas or other devices adapted to transmit radio frequency (RF) signals via the transmission medium 106. For example, the first coupler 130, the second coupler 134, or both may include a Yagi-Uda antenna or a quasi-Yagi antenna (e.g., an antenna including at least a reflector, a driven element and a director).

In a particular embodiment, the transmission medium 106 includes a surface wave (SW) medium 132. The SW medium 132 may include at least one first frequency selective surface (FSS) layer and at least one second FSS layer separated by a dielectric layer. A frequency selective surface layer includes a medium adapted to confine propagation of an electromagnetic wave to the surface of the medium. Examples of frequency selective media are illustrated and discussed with reference to FIG. 4. In a particular embodiment, the FSS layers may each include a plurality of conductive unit cells patterned on a polymer substrate. FSS layers may be referred to as or may include frequency selective surfaces, frequency selective media, periodic structures, photonic bandgap materials, electromagnetic bandgap materials, and metamaterials. In a particular embodiment, the first coupler 130 and the second coupler 134 include directional antennas coupled to the SW medium 132 between the FSS layers. In this embodiment, the directional antennas provide signals that are propagated by the SW media 132. For example, the signals may be propagated between the frequency selective media of the SW media 132. The couplers 130, 134 may be coupled to the SW media 132 at any point along the SW media 132. The system may be used to perform many functions, including to (1) transmit power only, where a remote end is used to generate a signal and transmit the signal back or transmit the signal forward; (2) transmit a data signal and a power signal where the remote end transmits signals forward (relay station); and (3) transmit a data signal and a power signal to the remote end where the remote end transmits return signals back to the primary station. In a particular embodiment, the transmission medium may include one or more primary nodes (such as the first node 102) and one or more remote nodes (such as the second node 104). For example, the first node 102 may be coupled to a plurality of remote nodes to enable point to multi-point communication and power transfer.

Figure 2:
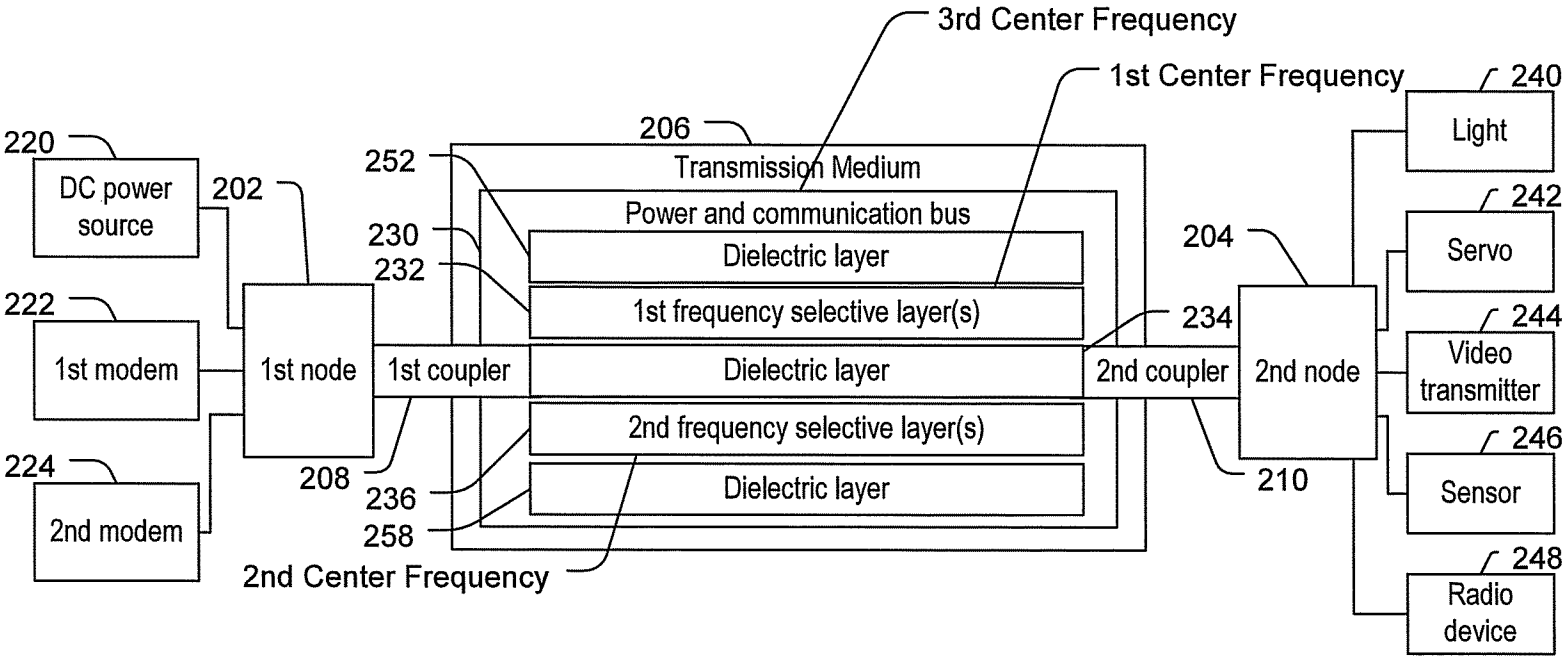
FIG. 2 is a block diagram of a second particular embodiment of a system to transmit power and data.

FIG. 2 depicts a second particular embodiment of a system to transmit power and data. The system includes a first node 202 coupled to a second node 204 via a transmission medium 206. For example, the first node 202 may be coupled to a first coupler 208 and the second node 204 may be coupled to a second coupler 210. The first coupler 208, the second coupler 210, or both, may include a directional antenna.

In a particular embodiment, the first node 202 is coupled to (e.g., electrically connected to) a direct current (DC) power source 220 and is adapted to convert the power to an RF power signal for transmission via the transmission medium 206 to the second node 204. In a particular embodiment, the first node 202 is coupled to (e.g., electrically connected to) a first modem 222. The first modem 222 may be adapted to receive data from a data source and to modulate the data to produce first RF data signals for transmission via the transmission medium 206 to the second node 204. The particular frequency or frequencies to which the RF power signal and the first RF data signals are modulated may be selected based on design characteristics of the transmission medium 206, the first node 202, the second node 204, one or more devices coupled to the first node 202 or the second node 204, or any combination thereof. The first node 202 may also be coupled to one or more second modem 224. The second modem 224 may be adapted to receive RF data signals from the second node 204 and to de-modulate the received RF data signals for communication to another component (not shown).

In a particular embodiment, the second node 204 is coupled to (e.g., electrically connected to) one or more sensors, control devices, other systems or components that receive the power signal, RF data signals, or both, from the first node 202 or that send the RF data signals to the first node 202. Additionally, the second node 204 may be coupled (e.g., electrically connected to) to one or more systems or components that receive the power signal from the first node and send data signals to the first node 202. For example, the second node 204 may be coupled (e.g., electrically connected to) to a light 240. The light 240 may be powered using the power signal received from the first node 202. In another example, the second node 204 may be coupled (e.g., electrically connected to) to a servomechanism 242. The servomechanism 242 may receive operating power via the power signal from the first node 202. Additionally, the first node 202 may send a control signal to the second node 204 to control operation of the servomechanism 242. In another example, the second node 204 may be coupled (e.g., electrically connected to) to a video transmitter 244. The video transmitter 244 may receive operating power via the power signal from the first node 202. Additionally, the video transmitter 244 may send video data via data signals to the first node 202. Further, the first node 202 may send a control signal to the video transmitter 244 to control reception of the video data. To illustrate, the control signal may control when the video transmitter 244 captures images for transmission to the first node 202.

In yet another example, the second node 204 may be coupled (e.g., electrically connected to) to a sensor 246. The sensor 246 may be adapted to receive power via the power signal from the first node 202. Additionally, the sensor 246 may be adapted to send sensed data to the first node 202 via the transmission medium 206. To illustrate, the second node 204 may send the sensed data received from the sensor 246 via the transmission medium 206 to the first node 202, and the first node 202 may concurrently transmit the power signal to the second node via the transmission medium 206. In another example, the second node 204 may be coupled (e.g., electrically connected to) to a radio device 248, such as a transmitter, a receiver, or a transceiver. The radio device 248 may receive power via the power signal from the first node 202. Additionally, the radio device 248 may receive information transmitted via data signals from the first node 202. Further, the radio device 248 may send information to the first node 202 via the transmission medium 206 in response to a received radio signal.

In a particular embodiment, the transmission medium 206 includes a power and communication bus 230. The power and communication bus 230 may include a one or more first frequency selective surface (FSS) layers 232 and one or more second FSS layers 236 separated by at least one dielectric layer 234. The power and communication bus 230 may also include one or more layers to isolate the power and communication bus 230 physically, electrically or both. For example, the power and communication bus may include a first outer dielectric layer 252 and a second outer dielectric layer 258. In a particular embodiment, when no outer layers are present, the material of the first outer dielectric layer 252, the second outer dielectric layer 258, or both, may be air.

In a particular embodiment, the first FSS layer(s) 232 have a first center frequency. The center frequency refers to a designed resonance frequency of an FSS layer. In a particular embodiment, the second FSS layer(s) 236 have a second center frequency that is different than the first center frequency. In such an arrangement the transmission medium 206 as a whole may have a third center frequency that is different from both the first center frequency and the second center frequency. To illustrate, the third center frequency may be between the first center frequency and the second center frequency. In another particular embodiment, the first center frequency, the second center frequency and the third center frequency may be the same. In a particular embodiment, the first FSS layer(s) 232 may operate within a first range of frequencies surrounding the first center frequency, and the second FSS layer(s) 236 may operate within a second range of frequencies surrounding the second center frequency. In such embodiments, the transmission medium 206 as a whole may operate within a third range of frequencies. The third range of frequencies may be broader than a sum of the first and the second center frequencies. The third frequency range may also include the first range of frequencies and the second range of frequencies. In an illustrative embodiment, the first modem 222 modulates the power signal to a frequency substantially equal to the first central frequency of the first FSS layer(s) 232 and the second modem 224 modulates the RF data signals to a second frequency substantially equal to the second central frequency of the second FSS layer(s) 236. In a particular embodiment, the first modem 222 modulates and sends a signal at approximately the first center frequency, and the second modem 224 modulates and sends a signal at approximately the second center frequency.

In a particular embodiment, additional transmission media (not shown) may be present between the devices coupled to the first node 202 and the devices coupled to the second node 204. For example, the transmission medium 206 may be used to transmit power from the DC power source 220 to one or more devices coupled to the second node 204 and data signals may be sent via a separate medium, such as a wired medium or a wave guide. In another example, the transmission medium 206 may be used to transmit data signals from the first modem 222 to one or more devices coupled to the second node 204, and power may be sent via a separate medium, such as a wired medium. Thus, multiple layers with different frequency ranges may be used in combination to broaden or to control transmission performance and bandwidth due to the combined design characteristics of each surface wave media.

Figure 3:
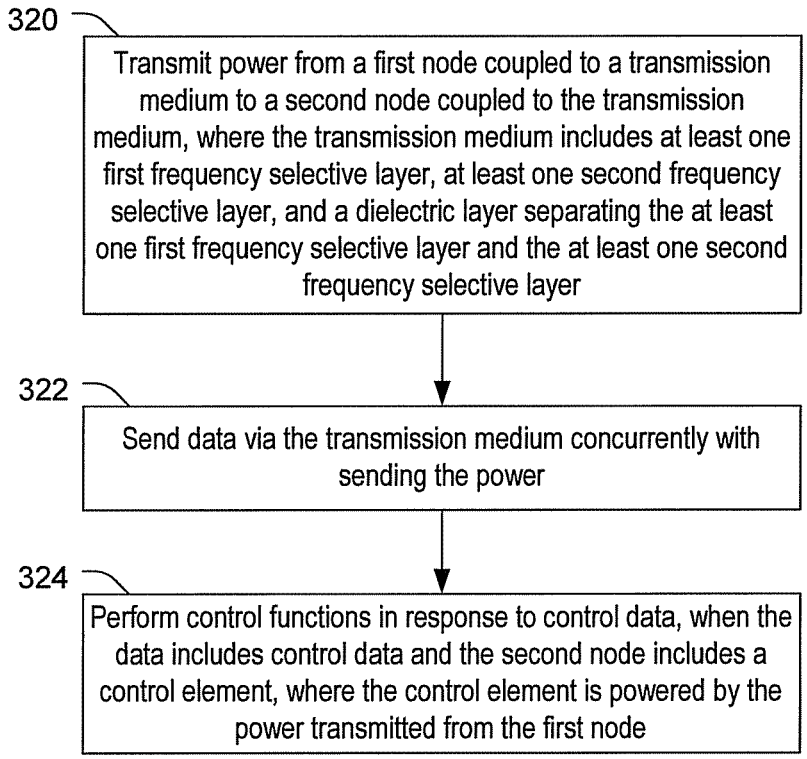
FIG. 3 is a flow diagram of a method of transmitting power and data via a transmission medium.

FIG. 3 depicts a flow diagram of a method of transmitting power and data via a transmission medium. The method includes, at 320, transmitting power from a first node coupled to a transmission medium to a second node coupled to the transmission medium. In a particular embodiment, the transmission medium includes at least one first frequency selective surface (FSS) layer, at least one second FSS layer, and a dielectric layer separating the at least one first FSS layer and the at least one second FSS layer. The method also includes, at 322, sending data via the transmission medium concurrently with sending the power. In a particular embodiment, the data sent may include control data. For example, the control data may be sent to a control element coupled to the second node. The control element may receive the power transmitted by the first node and may, at 324, perform control functions in response to the control data. In another example, the second node may receive the power from the first node and may send data to the first node via the transmission medium. For example, the second node may send video data or sensed data to the first node via the transmission medium concurrently with the first node sending the power to the second node.

Figure 4:
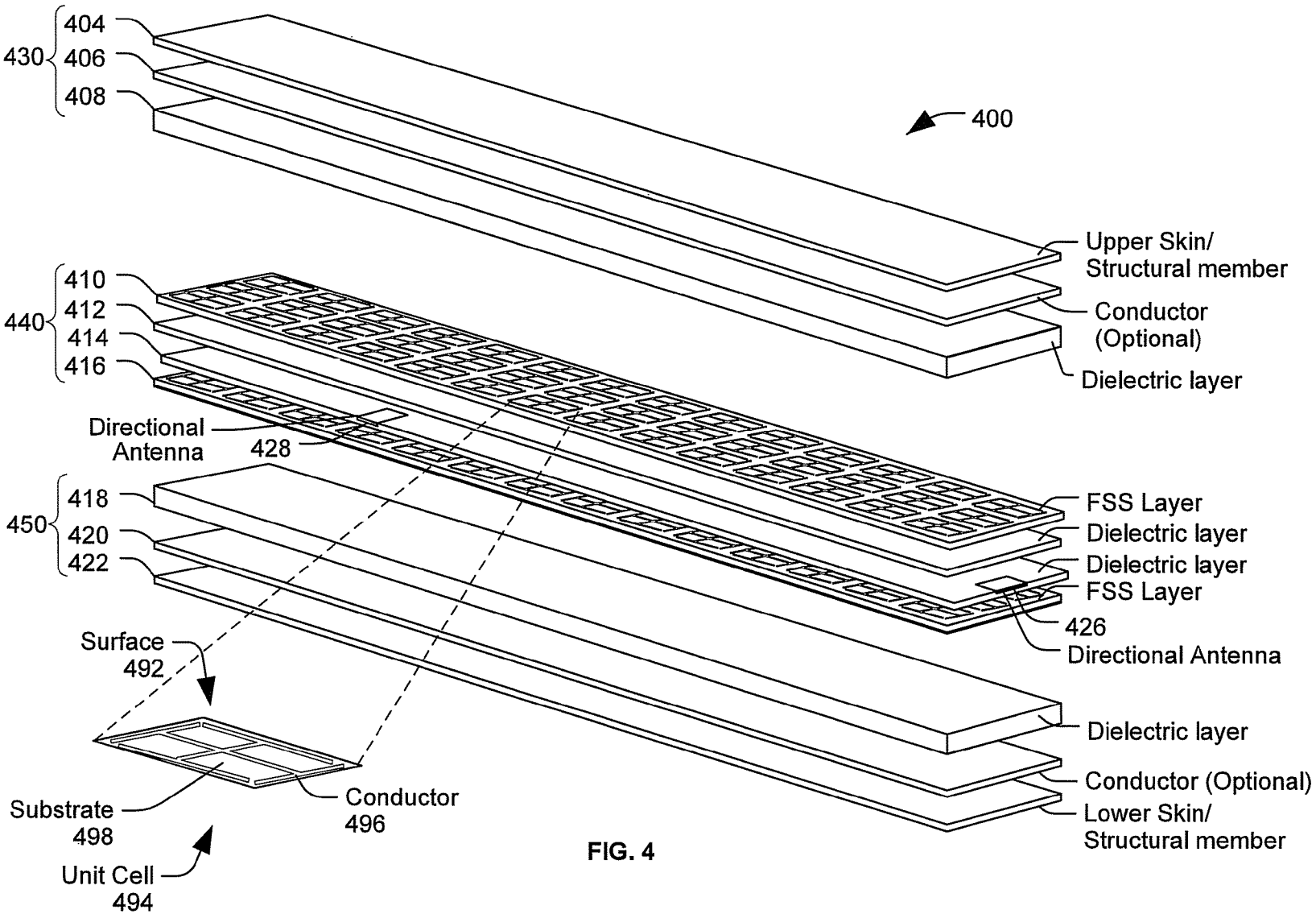
FIG. 4 is a blown up view of a particular embodiment of a system to transmit power and data via a transmission medium.

FIG. 4 illustrates a particular embodiment of a transmission medium, designated 400 that may be used to transmit power and data. The medium 400 illustrates a view of layers of a transmission medium in one particular embodiment. The medium 400 includes structural portions 430, 450 and a transmission portion 440. For example, the structural portions 430, 450 may include an upper skin/structural member 404 and a lower skin/structural member 422. In a particular embodiment, the upper skin/structural member 404 and the lower skin/structural member 422 are part of a protective skin that substantially covers the medium 400. For example, although they are not shown, the upper skin/structural member 404 and the lower skin/structural member 422 may be joined by side skins to fully enclose the sides or the sides and ends of the medium 400. The skins/structural members 404, 422 may provide protection against environmental damage. The skins/structural members 404, 422 may also provide stiffness, impact resistance and other characteristics to protect the medium 400 from damage and to provide structural support. The structural portions 430, 450 may optionally include conductors 406, 420. The conductors 406, 420 may provide electromagnetic isolation. For example, the conductors 406, 420 may act as a ground plane to prevent RF radiation leakage into or out of the medium 400. In particular embodiments, the skins/structural members 404, 422 may be conductive, in which case, the conductors 406, 420 may not be present. The structural portions 430, 450 may also include dielectric layers 408, 418. The dielectric layers 408, 418 may isolate the transmission portion 440 from the structural portions 430, 450. The dielectric layers 408, 418 may have a thickness selected to provide a desired distance between the transmission portion 440 (or portions thereof) and the conductors 406, 420, the skins/structural members 404, 422, or both. For example, the thickness of the dielectric layers 408, 418 may be selected to physically separate the transmission portion 440 (or portions thereof) from conductive elements that may cause attenuation of signals transmitted via the transmission portion 440.

In a particular embodiment, the transmission portion 440 may include a plurality of frequency selective surface (FSS) layers. For example, the transmission portion 440 may include two or more FSS layers, such as three FSS layers, four FSS layers, or more. Two or more of the FSS layers may be different from one another. For example, as illustrated in FIG. 4, the transmission portion 440 includes a first FSS layer 410 and a second FSS layer 416. In a particular embodiment, the first FSS layer 410 has a first central frequency, and the second FSS layer 416 has a second central frequency. The first FSS layer 410 and the second FSS layer 416 are separated by at least one dielectric layer, such as the illustrated dielectric layers 412, 414. The FSS layers 410, 416 may be adapted to propagate radio frequency (RF) signals parallel to a surface of the FSS layers 410, 416. In a particular embodiment, the RF signals propagate substantially between the FSS layers 410, 416. That is, electromagnetic radiation is substantially confined to an area between the FSS layers 410, 416.

In a particular embodiment, the dielectric layer(s) 412, 414 are coupled to a directional antenna 426. During operation, the directional antenna 426 may receive a RF signal and may introduce the RF signal into the transmission portion 440. The RF signal is transmitted along a surface of one or both of the FSS layers 410, 416 to a second directional antenna 428. The second directional antenna 428 may receive the RF signal and provide data, power, or both, to a node coupled to the second directional antenna 428. In a particular embodiment, the second directional antenna 428 is coupled to the dielectric layer (s) 412, 414 at a point along a length of the medium 400 or at an end of the medium 400. The medium 400 may include multiple first directional antennas 426, multiple second directional antennas 428, or both. Additionally, the first directional antenna 426, the second directional antenna 428, or both, may be moveable to other locations along the length of the medium 400 or at the ends of the medium 400. In particular embodiments, material properties and geometries of each of the structural portions 430, 450 and the transmission portion 440 may affect characteristics of signals transmitted via the medium 400.

In a particular embodiment, one or more of the FSS layers, such as the first FSS layer 410, includes a conductor 496 patterned on a surface 492 of a substrate 498. For example, the conductor 496 may include a copper layer, such as an approximately 1.3 millimeter copper layer. The conductor 496 may be patterned on the substrate 498 in a plurality of unit cells 494. The unit cells 494 may have various patterns and spacings depending on design parameters such as the amount of power to be transmitted, design frequency characteristics, design loss characteristics, and so forth. To illustrate, a particular system was tested where the first FSS layer 410 had a Jerusalem cross pattern (as is illustrated in FIG. 4) with 0.250 inch periodic spacing, and the second FSS layer 416 had a Jerusalem cross pattern with 0.217 inch periodic spacing patterned on a polyimide (e.g. Kapton®) substrate. The conductor 496 is patterned in a manner that facilitates propagation of radio frequency (RF) signals along the surface 492. To illustrate, during operation, signals may propagate parallel to the surface 492 of the FSS layer.

Figure 5:
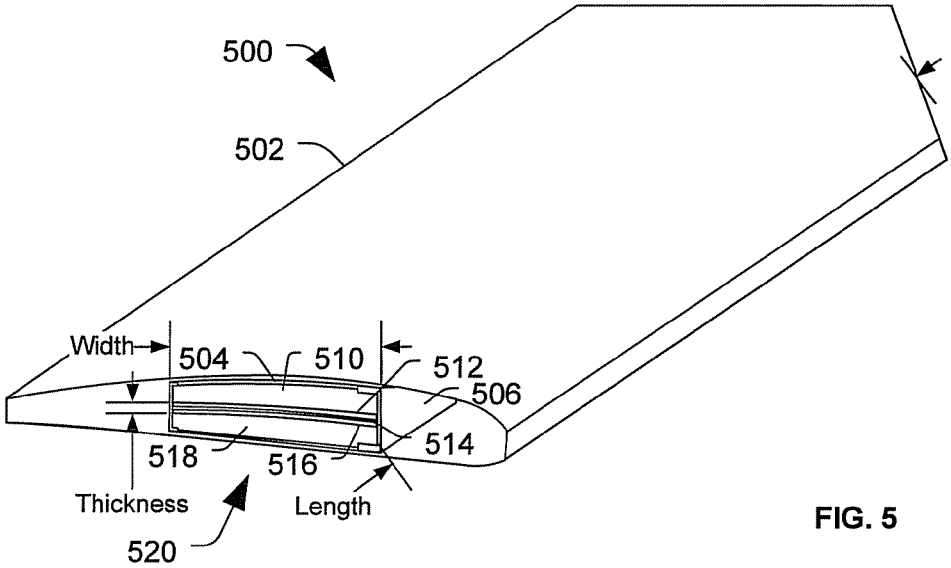
FIG. 5 is a cutaway view of a wing including a particular embodiment of a system to transmit power and data.

FIG. 5 depicts a cutaway view of a particular embodiment of a system to transmit power and data that includes a wing structure 500. The wing structure 500 includes a wing skin 502 and a transmission medium 520 embedded within the wing structure 500. In a particular embodiment, the transmission medium 520 may include a plurality of frequency selective surface (FSS) layers, such as the FSS layer 514 discussed with reference to FIG. 4. The transmission medium 520 may be used as a power and data bus to communicate power and data down a length of the wing structure 500. For example, a plurality of nodes, such as the nodes 102, 104 of FIG. 1 or the nodes 202, 204, may be coupled to the transmission medium 520 to send power and data signals along the wing structure 500.

The transmission medium 520 may run along a length of the wing structure 500. The transmission medium 520 may also have a width and a thickness (where the length is longer than the width or the thickness). Power and data signals may be transmitted along the length of the transmission medium 520. For example, power may be sent from a first node in a fuselage (not shown) of an aircraft down the wing structure 500 to a second node via the transmission medium 520. Additionally, data signals may be sent from the first node to the second node or from the second node to the first node concurrently with the power. The transmission medium 520 includes a first FSS layer 512 and a second FSS layer 516 separated by a dielectric layer 514. In an airborne system, such as the wing structure 500, it may be desirable for the dielectric layer 514 to have a high relative permittivity and a low density. For example, the dielectric layer 514 may include a foam, such as a Rohacell® foam. In a particular embodiment, the transmission medium 520 may be provided in a wing box 504. The wing box 504 may include structural members 506 that provide support for the wing skin 502. Additionally, the wing box 504 may include structural members 510, 518 that stiffen or strengthen the wing box 504 and protect the transmission medium 520.

Figure 6:
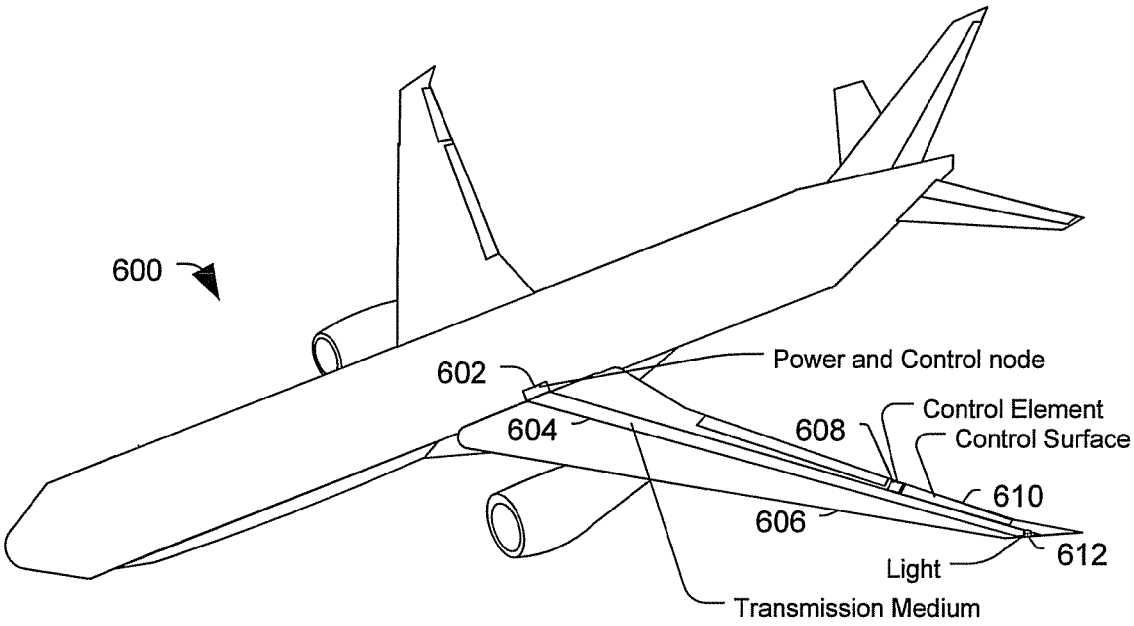
FIG. 6 is a perspective view of an aircraft including a particular embodiment of a system to transmit power and data through a transmission medium.

FIG. 6 depicts a perspective view of a particular embodiment of an aircraft 600 that includes a power and control node 602 coupled to a transmission medium 604. The transmission medium 604 is adapted to send power along a wing 606 of the aircraft 600 to one or more second nodes. For example, the second nodes may include a control element 608. To illustrate, the control element 608 may be adapted to control a position of a control surface 610. The control element 608 may receive power and control signals from the power and control node 602 via the transmission medium 604. The control element 608 may perform control functions in response to the control signals. For example, the control element 608 may change a position of the control surface 610 in response to the control signals. Additionally, the control element 608 may be powered by power received via the transmission medium 604 from the power and control node 602. Further, the control element 608 may send sensed data via the transmission medium 604 to the power and control node 602. To illustrate, the control element 608 may sense a position of the control surface 610 and may provide the sensed data via the transmission medium 604 to the power and controller node 602. The second nodes may also include other devices, such as a light 612. The power and control node 602 may provide power to the light 612 via the transmission medium 604 and substantially simultaneously provide control signals, sensor signals and/or power to the control element 608 via the transmission medium 604.

Particular embodiments enable a waveguide or other communication structure to be replaced with a flexible transmission medium. A waveguide includes a conductive or dielectric element used to propagate electromagnetic waves. A typical example of a waveguide includes a hollow or dielectric filled metal pipe down which electromagnetic waves propagate. Electromagnetic waves propagate down the waveguide as they are reflected off of opposing walls of the waveguide. Generally, the signals that will propagate through a waveguide depend on the dimensions of the waveguide, with lower frequencies requiring larger waveguide dimensions. Waveguides tend to be fairly bulky and are often custom made for a particular application. For example, to connect two nodes of a satellite or aircraft system, a routing of the waveguide between the two nodes may be determined based on an expected location of each node. If one or both of the nodes is moved (e.g., due to a design change) the waveguide may need to be removed and replaced, redesign, rerouted, or all of the above. Such changes to waveguides and their routings may be expensive and time consuming. Thus, the ability to move nodes to any point along the transmission medium, such as the transmission medium 206 discussed with reference to FIG. 2, may reduce costs and time required when changes are made to systems that include the transmission medium 206, such as aircraft or other vehicles. Additionally, the transmission medium may be formed of lighter materials (as described with reference to FIG. 4) reducing the overall weight of the aircraft or vehicle.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be reduced. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An apparatus, comprising:

a transmission medium comprising:

at least one first frequency selective surface (FSS) layer;

at least one second FSS layer; and a dielectric layer separating the at least one first FSS layer and the at least one second FSS layer;

a first coupler coupled to the dielectric layer to send a signal along the transmission medium; and a second coupler coupled to the dielectric layer to receive the signal sent along the transmission medium.

2. The apparatus of claim 1, wherein the transmission medium comprises a power and communication bus, wherein the first coupler is coupled to a first node and the second coupler is coupled to a second node, wherein the second node generates sensed data and sends the sensed data to the first node via the transmission medium, and wherein the first node concurrently transmits power to the second node via the transmission medium.

3. The apparatus of claim 1, wherein the first coupler transmits a power signal to a node coupled to the second coupler via the transmission medium.

4. The apparatus of claim 1, wherein the first coupler transmits a power signal to a first node coupled to the second coupler via the transmission medium and the second coupler sends a sensed data signal to a second node coupled to the first coupler via the transmission medium.

5. The apparatus of claim 1, wherein the signal propagates substantially between the first FSS layer and the second FSS layer.

6. The apparatus of claim 1, wherein the signal propagates along a surface of at least one of the at least one first FSS layer and the at least one second FSS layer.

7. The apparatus of claim 1, wherein the at least one first FSS layer has a first central frequency and the at least one second FSS layer has a second central frequency, and wherein the first central frequency is different than the second central frequency.

8. The apparatus of claim 7, wherein the transmission medium has a third central frequency, wherein the third central frequency is between the first central frequency and the second central frequency.

9. The apparatus of claim 1, wherein the first coupler is coupled to the dielectric layer at a first end of the transmission medium, and the second coupler is coupled to the dielectric layer at a location of the transmission medium other than an end of the transmission medium, and wherein the second coupler is movable to at least one second location of the transmission medium.

10. The apparatus of claim 1, wherein the transmission medium further comprises a second dielectric layer, wherein the second dielectric layer separates the dielectric layer from one of the at least one first FSS layer and the at least one second FSS layer.

11. The apparatus of claim 1, wherein the at least one first FSS layer includes a plurality of conductive unit cells patterned on a polymer substrate.

12. The apparatus of claim 1, wherein the transmission medium further comprises:

a second dielectric layer, wherein the at least one first FSS layer separates the dielectric layer and the second dielectric layer; and a first conductive layer, wherein the second dielectric layer separates the first conductive layer and the at least one first FSS layer.

13. The apparatus of claim 1, wherein the transmission medium is adapted to be coupled to or incorporated in a wing of an aircraft.

14. A method, comprising:

transmitting power from a first node coupled to a transmission medium to a second node coupled to the transmission medium, wherein the transmission medium includes:

at least one first frequency selective surface (FSS) layer;

at least one second FSS layer; and a dielectric layer separating the at least one first FSS layer and the at least one second FSS layer; and sending data via the transmission medium concurrently with transmitting the power wherein the first node is coupled to the transmission medium via a coupler that is coupled to the dielectric layer.

15. The method of claim 14, wherein the data includes control data, and wherein the second node includes a control element to perform control functions in response to the control data, wherein the control element is powered by the power transmitted from the first node.

16. A system, comprising:

a transmission medium comprising:

a first frequency selective surface (FSS) layer;

a second FSS layer; and a dielectric layer separating the first FSS layer and the second FSS layer;

a first node coupled to the transmission medium via a coupler that is coupled to the dielectric layer, wherein the first node is configured to transmit a power signal via the transmission medium; and a second node coupled to the transmission medium to receive the power signal;

wherein at least one of the first node and the second node communicate a data signal via the transmission medium concurrently with the power signal being transmitted via the transmission medium.

17. The system of claim 16, wherein the second node includes at least one of a communication device, a light, a servo responsive to the data signal, a video transmitter, a radio transmitter, and a sensor.

18. The system of claim 16, further comprising:

a first modulator to modulate the power signal to a first frequency substantially equal to a central frequency of the first FSS layer; and a second modulator to modulate the data signal to a second frequency substantially equal to a central frequency of the second FSS layer.

19. The system of claim 16, wherein the system comprises an aircraft.

20. The system of claim 16, wherein the transmission medium has a length, a width and a thickness, wherein the length is greater than the width and the thickness and wherein the power signal and the data signal are transmitted along the length of the transmission medium.

* * * * *